US006103158A

United States Patent [19]

Schafer et al.

[11] Patent Number: 6,103,158

[45] Date of Patent: Aug. 15, 2000

[54] METHOD AND APPARATUS FOR SPINNING A MULTIFILAMENT YARN

[75] Inventors: Klaus Schafer; Ernst Callhoff; Georg Stausberg, all of Remscheid, Germany

[73] Assignee: Barmag AG, Remscheid, Germany

[21] Appl. No.: 09/252,949

[22] Filed: Feb. 18, 1999

[30] Foreign Application Priority Data

Feb. 21, 1998 [DE] Germany ..... 198 07 507

[51] Int. Cl.[7] ..... D01D 5/092; D01D 5/16; D02G 3/00

[52] U.S. Cl. ..... 264/103; 264/210.8; 264/211.14; 264/237; 425/72.2; 425/378.2; 425/404; 425/464

[58] Field of Search ..... 264/103, 210.8, 264/211.14, 237; 425/72.2, 378.2, 404, 464

[56] References Cited

U.S. PATENT DOCUMENTS 4,045,534 8/1977 Fisher et al. ..... 264/237
4,277,430 7/1981 Peckinpaugh et al. .
5,173,310 12/1992 Katou et al. ..... 425/72.2

FOREIGN PATENT DOCUMENTS 0 244 217 11/1987 European Pat. Off. .
WO 95/15409 6/1995 WIPO .

*Primary Examiner*—Leo B. Tentoni
*Attorney, Agent, or Firm*—Alston & Bird LLP

[57] ABSTRACT

A method and an apparatus for spinning a multifilament yarn of a thermoplastic material, wherein the thermoplastic material is extruded through a spinneret to form a downwardly advancing filament bundle. The filaments then advance through a cooling device with two cooling zones. In the first cooling zone, an air stream is directed substantially transverse to the direction of the advancing filaments, and in the second cooling zone, cooling occurs by a cooling stream composed of a mixture of air and liquid, with the cooling stream flowing oppositely to the direction of the advancing filaments. The advancing filaments are gathered to form a multifilament yarn, which is then wound into a package.

24 Claims, 3 Drawing Sheets

METHOD AND APPARATUS FOR SPINNING A MULTIFILAMENT YARN

BACKGROUND OF THE INVENTION

The present invention relates to an improved method and apparatus for spinning a multifilament yarn.

A method and an apparatus of the described type are known from U.S. Pat. No. 4,277,430, which discloses an apparatus wherein a bundle of filaments emerging from a spinneret is cooled by directing a transverse airflow into contact with the filaments. Downstream of the transverse airflow cooling, the cooling shaft is lengthened by a second section. In the inlet region of the lower cooling shaft, a mixture of air and water is introduced into the cooling shaft as a mistlike cooling stream which flows by means of suction in the direction of the yarn advance and to the end of the cooling zone. In this process, a greater cooling effect is realized on the filaments by the addition of a liquid. However, this prior method has the disadvantage that a considerable portion of air enters from the transverse airflow directly into the lower cooling shaft. As a result, an airflow forms that surrounds each filament. This airflow prevents liquid particles from reaching the surface of the filament.

Methods and apparatus for melt spinning yarns are also known wherein at higher yarn speeds the filaments are cooled by an air stream that flows in the cooling shaft at a high velocity, as is disclosed, for example, in EP 0 244 217 or WO 95/1540. However, such methods basically have the disadvantage that there is no intensive cooling of the filaments. These methods are suitable in particular for yarns with relatively fine deniers. In addition, the known methods lead to a distinct hot drawing that results in an orientation of the molecules within the filaments.

It is accordingly an object of the invention to further develop a method and an apparatus for melt spinning a multifilament yarn of the initially described type in such a manner that the yarn can be cooled without undergoing a substantial partial orientation.

SUMMARY OF THE INVENTION

The above and other objects and advantages of the present invention are achieved by the provision of a method and apparatus wherein a heated thermoplastic melt is extruded through a spinneret to form a plurality of downwardly advancing filaments, and the downwardly advancing filaments are cooled by passing the same through first and second cooling zones. The filaments are cooled in the first zone by an air stream moving generally transverse to the direction of the advancing filaments, and the filaments are cooled in the second zone by an air stream which is of a relatively high moisture content and which flows in a direction generally opposite to the direction of the advancing filaments. Also, the advancing filaments are gathered to form an advancing multifilament yarn.

The invention is characterized in that the moist cooling stream entering into the second cooling zone in a counterflow direction results in a high degree of wetting of the filaments, so that it is possible to dissipate a relatively large amount of heat within a short time. In this process, it has come as a surprise that the cooling stream flowing in an opposite direction to the advancing yarn does not lead to a substantial increase of the frictional resistance of the yarn. On the contrary, it is possible to adjust the counterflow such that no protective sheathing is able to develop around the filament in the form of an air stream. The cooling that preferably consists of a mixture of air and liquid prevents such a protective sheathing from developing, and results in an intensive cooling of the filaments.

A further advantage of the invention is the fact that the uniformity of the filaments is improved since an initial cooling by the air stream occurs in the first cooling zone directly downstream of the spinneret. As a result of this initial cooling, a marginal layer of the filaments solidifies, which provides an adequate stability for coming into contact with the air/liquid mixture in the second cooling zone.

The method and apparatus of the present invention are especially suited for producing high-tensile yarns of polypropylene. Such yarns must be cooled with a lowest possible orientation, so as to obtain a highest possible drawing in a subsequent draw zone. Advantageously, drawing occurs in this instance via a plurality of paired godets. With the invention, yarns can be produced at a winding speed of up to 5,000 m/min.

In one embodiment of the invention, the air stream in the first cooling zone is supplied to the advancing filament bundle over its entire circumference and generally transverse to the direction of the advancing filaments, and the air stream is sucked off at the downstream end of the first cooling zone. This embodiment is especially suited to obtain a uniform cooling of the filaments within the filament bundle. Thus, it is possible to precool yarns with a denier of up to 2,000 dtex, so as to cool it thereafter in an intensive cooling by the air/liquid mixture without substantial partial orientation. In addition, the removal of the air current by suction in the first cooling zone has the advantage that the cooling stream of the second cooling zone is substantially unaffected and, thus, leads to an intensive and uniform cooling of the filaments. Furthermore, it is avoided that the air stream from the first cooling zone enters into the second cooling zone.

It has been shown that an adequate initial cooling may be realized in a cooling zone of less than 1 m, preferably less than 0.5 m. In this connection, it is possible to generate the air stream depending on the yarn type and yarn denier by blowing or self-aspiration. In the case of self-aspiration, there is the advantage that a very weak air stream forms directly downstream of the spinneret, which leads to a very uniform denier. However, blowing has the advantage that the filaments within the bundle are cooled relatively evenly.

Preferably an air/liquid mixture is used as a cooling stream. In this connection, the mixing ratio may be selected such that saturated or unsaturated moist air develops. The use of saturated moist air has the advantage that a high liquid component leads to an intensive cooling of the filaments. Such a mixture is used in particular for high yarn deniers. In the case of low-denier yarns, however, it is preferred to use unsaturated moist air. In this process, the moisture content of the air is regularly monitored, for example, by checking the dew point.

In a particularly advantageous embodiment, a blower generates the cooling air stream at the downstream end of the second cooling zone and a liquid is added to the air stream by means of an atomizer nozzle. This effects a very intensive cooling of the filaments in particular in the lower section of the second cooling zone.

An embodiment of the invention which is especially suited for producing industrial yarns involves the generation of the cooling stream by suction. At the end of the cooling zone, liquid is added by means of an atomizer nozzle to an air stream generated by suction.

However, it is also possible to enrich the air with moisture in an air conditioning chamber. In this instance, it is possible to adjust and regulate the moisture content of the air very precisely, so that with the use of a plurality of spinning positions an air stream with the same moisture content is available at each spinning position. To obtain, if possible, a uniform distribution of the liquid within the cooling stream, a further embodiment of the invention may be employed wherein the second cooling zone is divided into two sections, and the atomized liquid is supplied between the two sections so that the cooling air stream contains no liquid in one section at the end of the cooling zone.

In the method of the present invention, water is preferably used as the atomized liquid.

The spinning apparatus of the present invention is characterized in particular in that the cooling device comprises two cooling zones whose cooling effect is adjustable and controllable independently of each other.

To generate the air/liquid mixture in the cooling stream of the lower cooling shaft, an atomizer nozzle may be positioned within the lower region of the cooling shaft, with the atomizer nozzle connected to a metering pump which in turn is connected to a supply tank. In this embodiment, the liquid is added in very fine drops to the air stream already generated in the cooling shaft. Thus, the metering pump advances the liquid under high pressure through the atomizer nozzle. In this manner, a mistlike cooling stream develops that flows oppositely to the direction of the advancing yarn.

To realize a highly uniform distribution of the liquid within the cooling stream, the nozzle opening may be made annular so as to surround the filament bundle as it advances through the cooling shaft.

However, to obtain a favorable distribution of the atomized liquid, it is also possible to arrange a plurality of atomizer nozzles in the cooling shaft of the second cooling zone.

The upper cooling shaft is preferably formed by a peripherally air permeable tube, and the lower cooling shaft is formed by a peripherally closed tube, and a suction device is located between the two tubes. This construction is advantageous in the case of annular spinnerets. As a result it is possible to cool the filament bundle uniformly both in the upper cooling shaft and in the lower cooling shaft. In particular, it is possible to supply the cooling air stream as close as possible to the filament bundle through the closed tube in the lower region of the cooling device.

A blower housing preferably surrounds the entire length of the air permeable tube of the upper cooling shaft, which offers the advantage of evenly cooling the filaments within the filament bundle.

The suction device may connect to a water separator that supplies the separated liquid to a tank. The metering pump can then be supplied from the tank, so that a liquid circulation system is formed.

The suction device, when positioned between the upper and lower cooling shafts so as to suck off both air streams, may comprise two independently controllable units that are connected to the respective shafts. This is especially suited for performing a self-aspirating cooling of the filaments in the upper cooling shaft. In this embodiment, the air streams that are generated for cooling the filaments may be adjusted essentially by the suction device associated with each cooling shaft.

BRIEF DESCRIPTION OF THE DRAWINGS

Some embodiments of the spinning apparatus in accordance with the invention as well as advantageous effects of the method of the present invention are described in more detail with reference to the attached drawings in which.

DETAILED DESCRIPTION OF THE PREFERRED EMBODIMENTS

Figure 1:
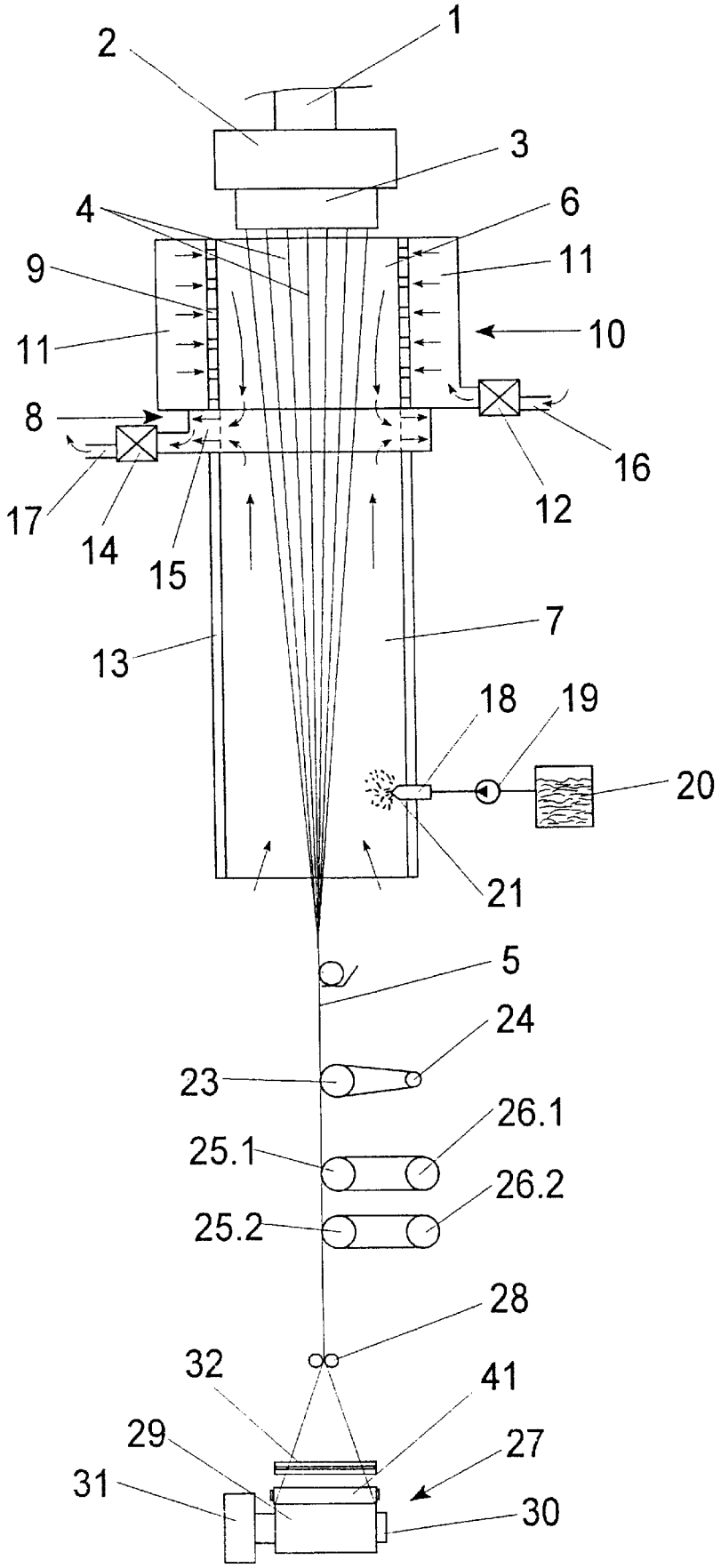
FIG. 1 is a schematic view of a spinning apparatus according to the invention for spinning a multifilament yarn.

FIG. 1 is a schematic view of a spinning apparatus in accordance with the invention for producing a multifilament yarn. In this apparatus, a thermoplastic material is supplied via a melt line 1 to a spin beam 2. The thermoplastic material could be supplied in this instance directly by an upstream extruder or alternatively by a pump.

The underside of the spin beam 2 mounts a spinneret 3. It is common to mount on the spin beam 2 several, preferably serially arranged spinnerets. Each of the spinnerets represents a spinning position of the spinning apparatus. Since each spinning position produces one yarn, only one spinning position is shown in FIG. 1.

From the spinneret 3, the melt emerges in the form of fine filament strands that form a filament bundle 4. The filament bundle 4 advances through a cooling shaft 6 downstream of the spinneret 3. An air-permeable tube 9 forms the cooling shaft 6. To this end, the tube 9 includes a plurality of transverse bores. However, the tube could be made of an air-permeable, porous casing. The tube 9 is arranged in an air shaft housing 11 of a blowing device 10. In the housing 11, an air stream is generated by a blower 12. To this end, the blower 12 connects to an inlet 16. Via inlet 16, it is possible to suck in conditioned air from an air-conditioning system or alternatively ambient air.

Downstream of the upper cooling shaft 6, a tube 13 through which the filament bundle 4 advances forms a lower cooling shaft 7. Between the tube 9 and the tube 13 a suction device 8 is arranged. The suction device 8 is formed by an annular suction chamber 15 that surrounds the filament bundle, and a blower 14 connected to the suction chamber 15. The inside wall of suction chamber 15 is likewise air-permeable, so as to permit removal of an air stream from cooling shafts 6 and 7. To this end, the suction device 8 has an outlet 17.

In the illustrated embodiment, the tube 13 is a closed casing. In the region of the free end of tube 13, an atomizer nozzle 18 is arranged on the circumference of tube 13. The atomizer nozzle 18 has a nozzle opening 21 that is directed into the interior of tube 13. The atomizer nozzle 18 connects to a pressure line of a metering pump 19 that is connected via a suction line to a tank 20.

At the lower end of cooling shaft 7, the filament bundle 4 is combined to a yarn 5 outside of the cooling shaft 7 by a lubrication device 22 and provided with a liquid lubricant. Subsequently, the yarn 5 enters into a draw zone. In so doing, a godet 23 withdraws the yarn 5 from cooling shafts 6 and 7 and from the spinneret 3. The yarn loops about godet 23 several times. To this end, a guide roll 24 is used that is axially inclined relative to godet 23. The guide roll 24 is freely rotatable. The godet 23 is driven via a drive (not shown) and operated at a preadjustable speed. This withdrawal speed is by a multiple higher than the natural exit speed of the filaments from spinneret 3. Downstream of the withdrawal godet is a draw zone with a plurality of godets. Illustrated are two pairs of godets, namely godets 25.1 and 26.1 as well as paired godets 25.2 and 26.2.

From the last godet 25.2, the yarn 5 advances to a takeup device 27. The takeup device 27 comprises a yarn guide 28 that forms the apex of a so-called traversing triangle. Subsequently, the yarn advances into a traversing device 32, wherein guide elements reciprocate the yarn along a traverse stroke. The traversing device may be realized by a cross-spiralled roll with a yarn guide extending thereon, or by rotary blades. From the traversing device 32, the yarn advances via a contact roll 41 to a package 29 that is to be wound. The contact roll 41 lies against the surface of package 29. It serves to measure the surface speed of the package 29. The package 29 is mounted on a winding spindle 30 that is mounted for rotation in a frame 31. A spindle motor (not shown) drives the winding spindle 30 such that the surface speed of the package 29 remains constant. To this end, the rotational speed of the freely rotatable contact roll 41 is sensed as a control variable and adjusted via the spindle motor.

In the spinning apparatus shown in FIG. 1, the filaments 4 are cooled, after emerging from the spinneret 3, by an air stream that is directed radially over the circumference toward the filament bundle 4 by means of the blowing device 10. As a result, the filaments initially undergo a precooling that leads to solidification of a marginal layer of the filaments. The air stream is substantially entrained by the advancing filaments and removed by the suction device 8 downstream of cooling shaft 6. Subsequently, the filaments 4 advance through the lower cooling shaft 7. In the lower cooling shaft 7, a cooling stream flows in a direction opposite to the advancing yarn up to the suction device 8. This cooling stream is generated by suction device 8 that sucks ambient air into the cooling shaft at the lower end of the tube 13. The air stream entering in the lower region of tube 13 is mixed by means of atomizer nozzle 18 with a liquid in the form of very fine droplets. This air/liquid mixture flows as a result of the suction effect of suction device 8 in an opposite direction to the advancing yarn. In so doing, the filaments 4 undergo an intensive cooling. As a result of adding the liquid, a relatively large heat transfer is generated, so that the filaments are cooled without undergoing a substantial orientation. The cooling stream may be adjusted such that, surprisingly, no substantial frictional forces engage the yarn, or that the frictional forces have no negative effect due to the rapid cooling. Thus, the yarn 5 enters substantially unoriented into the downstream draw zone. By godets 25.1, 25.2, and 26.1, 26.2 the yarn undergoes a complete drawing. Subsequently, it is wound to a package. The method of the present invention facilitates takeup speeds up to 5,000 m/min. As a result of these high takeup speeds, it has become possible to increase output considerably, for example, in the production of polypropylene yarns.

With the use of the cooling device it has shown that the first cooling zone with cooling shaft 6 of a length no greater than 0.1 to 0.5 m leads to a solidification of the marginal zone that allows a subsequent liquid cooling of the filaments without impairing the evenness of the filaments. However, the first cooling zone should possibly be realized of a length from 0.1 to 1 m. In the second cooling zone, the cooling effect is dependent substantially on the portion of the liquid in the cooling stream. However, the portion of the liquid is primarily dependent on the fineness of the liquid mist.

The method of the present invention is however not limited to the production of polypropylene yarns. It is likewise possible to produce by this method polyamide or polyester yarns. Likewise the draw zone shown in FIG. 1 is only an example of treating a yarn. As a function of the yarn type, the treatment after withdrawing the yarn from the spinneret may be supplemented or replaced with drawing, heating, relaxing, or entangling. Likewise, it is possible to operate the spinning apparatus without godets. In this instance, the yarn is directly withdrawn from the spinneret by a takeup device.

Figure 2:
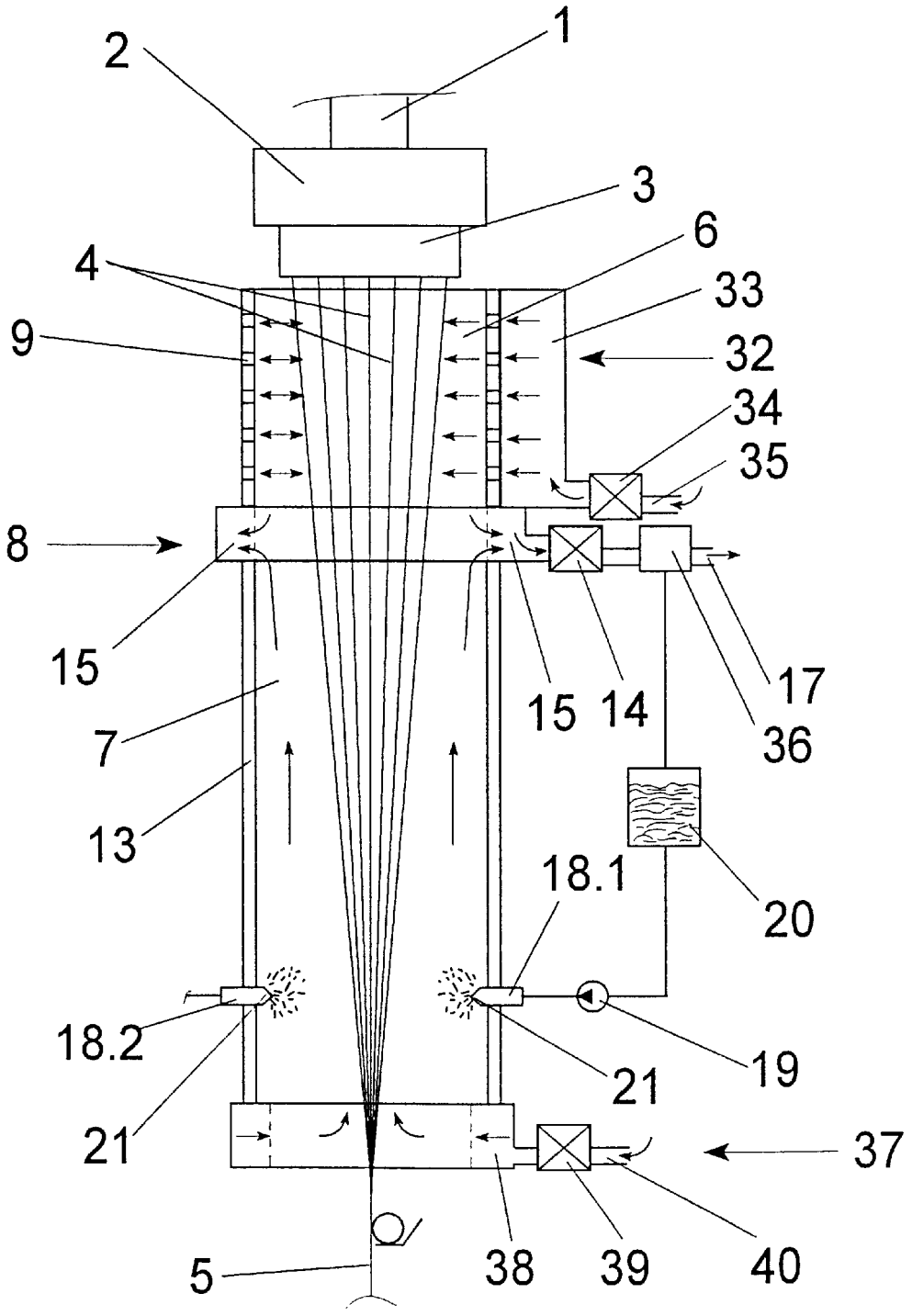
FIGS. 2 and 3 are schematic views of further embodiments of a cooling device in a spinning apparatus of FIG. 1.

FIG. 2 shows a further embodiment of a device for cooling the filaments as could be used, for example, in a spinning apparatus of FIG. 1. In this embodiment, the first cooling zone is again formed by tube 9 and the second cooling zone by tube 13. On its one side, the tube 9 is connected to an air chamber 33 of a blowing device 32. The blowing device 32 is of the so-called cross-flow type. In this device, a blower 34 furnishes, via an inlet 35, a cooling air stream into the air chamber 33. In the region of air chamber 33, the air stream enters through the porous tube wall unilaterally within the cooling shaft 6, thereby precooling the filaments. As previously shown in FIG. 1, the suction device 8 is arranged between tube 9 and tube 13. In comparison with the suction device shown in FIG. 1, the suction device of FIG. 2 comprises a connection to a water separator 36. Blower 14 guides the cooling stream that is sucked out of the lower cooling shaft 7 to the water separator. In the water separator, the gaseous components of the cooling stream are separated from the liquid components. The gaseous components of the cooling stream are removed through outlet 17. The liquid components are supplied to a tank 20. The tank 20 is used at the same time to supply a metering pump 19 that supplies the atomizer nozzle 18 in the lower region of the cooling shaft 7. This arrangement has the advantage that the liquid added to the cooling stream is continuously regenerated and returned to the cooling stream.

In the cooling device shown in FIG. 2, the atomizer nozzle 18 is positioned in the outlet region of cooling shaft 7 in such a manner that a plurality of nozzle openings are arranged radially over the circumference of the tube 13. With this arrangement, it is accomplished that the atomized liquid is very uniformly distributed in the air stream. The air stream is generated in this instance by a blowing device 37 arranged at the outlet of lower cooling shaft 7. To this end, the blowing device 37 comprises an air inlet 40, a blower 39, and an air chamber 38. The air chamber 38 is connected to cooling shaft 7 in an air-permeable manner. The air chamber 38 is made annular, so that an air stream flows radially into the cooling shaft 7. As a result of this construction of the cooling device, it is possible to still further intensify cooling of the filaments.

A further embodiment of a cooling device is given by modifying the spinning apparatus shown in FIG. 2. In this modified embodiment, the blowing device 37 arranged at the end of cooling tube 13 connects the air inlet 40 to a chamber. In this chamber an air/liquid mixture is produced with a certain moisture content of the air. The moist air is sucked by blower 39 out of the chamber and blown into air chamber 38. From air chamber 38, the moist air reaches the filaments as a counterflow by a vacuum generated in tube 13. In this instance, it is not necessary to supply liquid directly through atomizer nozzles 18. The atomizer nozzles may be arranged, for example, in the chamber, so as to generate a saturated or an unsaturated moist air.

Figure 3:
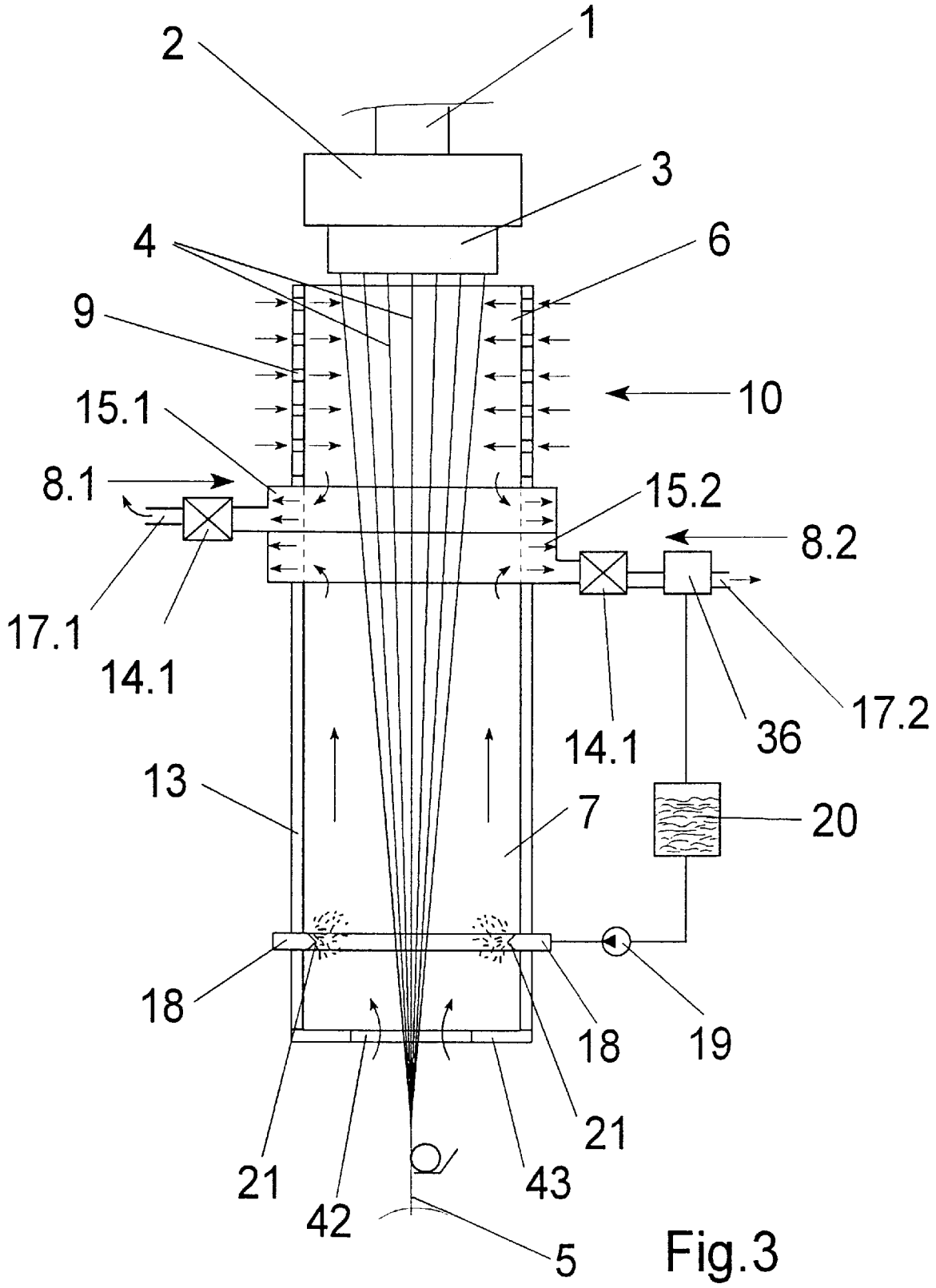

Illustrated in FIG. 3 is a further embodiment of a cooling device, as could be used, for example in a spinning apparatus of FIG. 1. In the device of FIG. 3, the suction device between the upper cooling shaft 6 and the lower cooling shaft 7 is formed by two structural units 8.1 and 8.2. The structural unit 8.1 connects to the tube 9 of the first cooling zone. The tube 9 is made air permeable over its entire circumference. Thus, the suction device 8.1 generates an air stream that radially enters from the outside into the cooling shaft 6 and leaves via blower 14.1 and outlet 17.1. This arrangement has the advantage that a relatively weak air stream develops directly downstream of the spinneret. The weak air stream favors cooling of the filaments in such a manner as to form on the filaments a uniform, solidified sheathing zone. Directly downstream of the spinneret 3, the emerging filaments 4 are still molten, so that a strong air stream affects the evenness of the filament strands. This arrangement is thus suitable in particular for such polymer types for which a slow precooling of the filaments is desired in the first cooling zone. Downstream of the first cooling zone, the second cooling zone is formed with tube 13. The tube 13 is arranged with its upper end on suction device 8.2. As shown in the case of the cooling device of FIG. 2, the suction device 8.2 of FIG. 3 is connected to the water separator 36. To this extent, the description of FIG. 2 is herewith incorporated by reference.

However, in the embodiment of FIG. 3, the cooling stream in cooling shaft 7 is generated exclusively by the suction device 8.2. At the end of tube 13, a plate 43 is arranged which has an opening 42 through which the filament bundle exits. This configuration has the advantage that an air stream aligned in the center of the cooling shaft 7 is generated.

The atomizer nozzle shown in FIG. 3 is made annular, so that the nozzle opening uniformly injects the liquid radially over the circumference into the air stream entering through the opening 42.

The invention has been described in detail with particular reference to a preferred embodiment and the operation thereof but it should be understood that variations, modifications, and the substitution of equivalent means can be effected within the spirit and scope of the invention.

That which is claimed is:

1. A method of melt spinning a multifilament yarn comprising the steps of extruding a heated thermoplastic melt through a spinneret to form a plurality of downwardly advancing filaments, cooling the downwardly advancing filaments by passing the same through a first cooling zone and then a second and final cooling zone, with the filaments being cooled in the first cooling zone by an air stream moving generally transverse to the direction of the advancing filaments, and with the filaments being cooled in the second cooling zone by an air stream which is of a relatively high moisture content and which flows in a direction generally opposite to the direction of the advancing filaments along substantially the entire length of the second cooling zone, and gathering the advancing filaments to form an advancing multifilament yarn.

2. The method as defined in claim 1 wherein the air stream in the first cooling zone is sucked off at a downstream end of the first cooling zone.

3. The method as defined in claim 2 wherein the air stream in the first cooling zone is supplied to the plurality of filaments over a cooling length which is less than about one meter.

4. The method as defined in claim 2 wherein the air stream in the first cooling zone is blown onto the plurality of filaments.

5. The method as defined in claim 2 wherein the air stream in the first cooling zone is generated by self-aspiration.

6. The method as defined in claim 1 wherein the air stream in the second cooling zone comprises saturated or unsaturated moist air.

7. The method as defined in claim 1 wherein the air stream in the second cooling zone is generated by causing air to enter into the downstream end of the second cooling zone and adding an atomized liquid into the generated air stream.

8. The method as defined in claim 7 wherein the air stream in the second cooling zone is caused to enter into the downstream end of the second cooling zone by means of a blower or by suction, and wherein the atomized liquid is added into the generated air stream adjacent the downstream end of the second cooling zone.

9. The method as defined in claim 7 wherein the atomized liquid is added into the air stream at a location spaced upstream from the downstream end of the second cooling zone so as to define an end section of the second cooling zone wherein the atomized liquid is not present.

10. The method as defined in claim 7 wherein the atomized liquid consists essentially of water.

11. The method as defined in claim 1 wherein the air stream in the first zone and the air stream in the second zone are both sucked off by a suction device located between the first and second zones.

12. The method as defined in claim 1 comprising the further subsequent steps of drawing the advancing multifilament yarn and winding the same into a package.

13. A melt spinning apparatus for producing a multifilament yarn, comprising a spinneret through which a heated thermoplastic material is extruded to form a plurality of downwardly advancing filaments, a cooling chamber disposed below the spinneret for cooling the advancing filaments and comprising an upper cooling shaft and a lower cooling shaft, and a suction device positioned between the upper and lower cooling shafts for removing by suction an air stream from the upper cooling shaft and an air stream from the lower cooling shaft and so as to cause the airstream in the lower cooling shaft to move in a direction generally opposite the direction of the advancing filaments, guide means for gathering the advancing filaments to form an advancing multifilament yarn, and a winder for winding the advancing multifilament yarn into a package.

14. A melt spinning apparatus as defined in claim 13 further comprising at least one atomizing nozzle position in the lower cooling shaft for injecting an atomized liquid thereinto.

15. The melt spinning apparatus as defined in claim 14 wherein the atomizing nozzle is annular so as to at least substantially surround the plurality of advancing filaments.

16. The melt spinning apparatus as defined in claim 14 comprising a plurality of said atomizing nozzles which are uniformly distributed about the circumference of the plurality of advancing filaments.

17. The melt spinning apparatus as defined in claim 14 wherein the upper cooling shaft comprises an air permeable tube, wherein the lower cooling shaft comprises a peripherally closed tube, and wherein both tubes communicate with said suction device.

18. The melt spinning apparatus as defined in claim 14 wherein the upper cooling shaft comprises an air permeable tube, and wherein the cooling chamber further comprises a housing surrounding at least substantially the entire length of said air permeable tube, and a blower for blowing air into said housing.

19. The melt spinning apparatus as defined in claim 14 wherein the suction device is connected to a liquid separator, and wherein the liquid separator is operatively connected to the at least one atomizing nozzle so as to supply the separated liquid thereto.

20. The melt spinning apparatus as defined in claim 13 further comprising a blower positioned so as to blow air into the downstream end of the lower cooling shaft and so that the air stream in the lower cooling shaft moves in a direction opposite the direction of the advancing filaments.

21. The melt spinning apparatus as defined in claim 13 wherein the suction device comprises two independently controlled suction units which are connected to respective ones of the upper and lower cooling shafts.

22. The melt spinning apparatus as defined in claim 13 further comprising a device for increasing the moisture content of the air stream which moves through the lower cooling shaft.

23. A method of melt spinning a multifilament yarn comprising the steps of extruding a heated thermoplastic melt through a spinneret to form a plurality of downwardly advancing filaments, cooling the downwardly advancing filaments by passing the same through first and second cooling zones, with the filaments being cooled in the first zone by an air stream moving generally transverse to the direction of the advancing filaments, and with the filaments being cooled in the second zone by an air stream which is of a relatively high moisture content and which flows in a direction generally opposite to the direction of the advancing filaments, and wherein the air stream in the first cooling zone is sucked off at a downstream end of the first cooling zone, and gathering the advancing filaments to form an advancing multifilament yarn.

24. A method of melt spinning a multifilament yarn comprising the steps of extruding a heated thermoplastic melt through a spinneret to form a plurality of downwardly advancing filaments, cooling the downwardly advancing filaments by passing the same through first and second cooling zones, with the filaments being cooled in the first zone by an air stream moving generally transverse to the direction of the advancing filaments, and with the filaments being cooled in the second zone by an air stream which is of a relatively high moisture content and which flows in a direction generally opposite to the direction of the advancing filaments, and wherein the air stream in the second cooling zone is generated by causing air to enter into the downstream end of the second cooling zone and adding an atomized liquid into the generated air stream, and gathering the advancing filaments to form an advancing multifilament yarn.

* * * * *